US007357487B2

(12) United States Patent
Kusunoki

(10) Patent No.: US 7,357,487 B2
(45) Date of Patent: Apr. 15, 2008

(54) IMAGE FORMING APPARATUS USING LIQUID WITH ELECTRORHEOLOGICAL PROPERTIES AND METHOD OF CONTROLLING SAME

(75) Inventor: Naoki Kusunoki, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 426 days.

(21) Appl. No.: 11/081,548

(22) Filed: Mar. 17, 2005

(65) Prior Publication Data

US 2005/0206683 A1 Sep. 22, 2005

(30) Foreign Application Priority Data

Mar. 19, 2004 (JP) ..... 2004-080996

(51) Int. Cl.
*B41J 2/04* (2006.01)

(52) U.S. Cl. ..... 347/54; 347/55

(58) Field of Classification Search ..... 347/14, 347/16, 19, 55, 101, 105, 102, 54, 112, 125, 347/126

See application file for complete search history.

(56) References Cited

U.S. PATENT DOCUMENTS 6,179,418 B1 * 1/2001 Mizoguchi et al. ..... 347/105

FOREIGN PATENT DOCUMENTS

| | | | |
|---|---|---|---|
| JP | 02-212149 | A | 8/1990 |
| JP | 5-4342 | A | 1/1993 |
| JP | 5-4343 | A | 1/1993 |
| JP | 2001-301131 | A | 10/2001 |
| JP | 2002-254619 | A | 9/2002 |

* cited by examiner

*Primary Examiner*—Juanita D. Stephens
(74) *Attorney, Agent, or Firm*—Birch, Stewart, Kolasch & Birch, LLP

(57) ABSTRACT

The image forming apparatus comprises: a droplet ejection head which ejects a droplet of a liquid having electrorheological properties toward a recording medium; an electric field application device which applies an electric field to the droplet deposited on the recording medium; a recording medium type determining device which determines a type of the recording medium; and an electric field intensity controller which controls intensity of the electric field applied to the droplet deposited on the recording medium by the electric field application device, in accordance with a determination result for the recording medium obtained through the recording medium type determining device, in such a manner that a permeation velocity into the recording medium of the droplet deposited on the recording medium becomes a prescribed permeation velocity.

21 Claims, 11 Drawing Sheets

IMAGE FORMING APPARATUS USING LIQUID WITH ELECTRORHEOLOGICAL PROPERTIES AND METHOD OF CONTROLLING SAME

BACKGROUND OF THE INVENTION

1. Field of the Invention

The present invention relates to an image forming apparatus, and more particularly, to a recording control technology in an image forming apparatus which forms images by means of dots formed by ejecting droplets onto a recording medium.

2. Description of the Related Art

Inkjet recording apparatuses (inkjet printers) having an inkjet head (ink ejection head) in which a plurality of nozzles are arranged, are known as image forming apparatuses. An inkjet recording apparatus of this kind forms images by forming dots on a recording medium, by ejecting ink as droplets from nozzles, while causing the inkjet head and the recording medium to move relatively to each other.

Various methods are known conventionally as ink ejection methods for an inkjet recording apparatus of this kind. For example, one known method is a piezoelectric method, where the volume of a pressure chamber (ink chamber) is changed by causing a vibration plate forming a portion of the pressure chamber to deform due to deformation of a piezoelectric element (piezoelectric actuator), ink being introduced into the pressure chamber from an ink supply passage when the volume is increased, and the ink inside the pressure chamber being ejected as a droplet from the nozzle when the volume of the pressure chamber is reduced. Another known method is a thermal inkjet method where ink is heated to generate a bubble in the ink, and ink is then ejected by means of the expansive energy created as the bubble grows.

In an inkjet recording apparatus, one image is represented by combining dots formed by ink ejected from the nozzles. High image quality can be achieved by making the dots small in size, increasing the density of the dots and thereby using a large number of pixels per image.

However, if the density of the dots is increased, then ink droplets (dots) which are adjacent or overlapping on the recording medium may become smeared or their colors may become mixed, and smearing or color mixing of this kind will cause the image quality to deteriorate.

Therefore, conventionally, various methods have been proposed in order to prevent smearing or color mixing of ink. For example, Japanese Patent Application Publication No. 5-4342 discloses a recording apparatus in which a recording liquid having electrorheological properties is formed into droplets by a recording head and caused to adhere to an intermediate transfer medium having an electric field created on the surface thereof, thereby raising the viscosity of the droplets on the transfer medium, and the recording liquid is then transferred in this state of increased viscosity onto a transfer receiving medium, thereby preventing excessive spreading or color mixing caused by the recording head and hence making it possible to achieve high-quality printing. However, in the recording apparatus described in Japanese Patent Application Publication No. 5-4342, time is required for the recording droplets to dry on the intermediate transfer medium, and this leads to a decline in recording speed. Furthermore, if the image is transferred in a state where an electric field is applied, then it is not possible to control smearing after transfer.

Japanese Patent Application Publication No. 5-4343 discloses a recording apparatus in which a recording liquid having electrorheological properties is formed into droplets by a recording head and caused to adhere to a transfer medium formed with an electric field, whereby the viscosity or yield value of the adhering droplets of recording liquid is increased. Therefore, blurring, smearing or color mixing of the recorded dots is prevented and high-quality printing can be achieved.

However, in the recording apparatus described in Japanese Patent Application Publication No. 5-4343, even if it is possible to restrict the rate of smearing of the recording dots by applying an electric field, smearing of the recording dots still continues for a long period of time after the electric field is removed.

Both of the aforementioned cases describe the possibility of preventing smearing of recording dots by applying an electric field to droplets of recording liquid having electrorheological properties; however, they do not disclose a method for controlling the permeation velocity of the recording droplets, at which the recording droplets permeate into the recording medium, to an optimum velocity, and neither do they give any explanation of the relationship between the permeation of the recording dots and smearing. Hence, there is a problem in that smearing of the recording dots, and the like, cannot be controlled optimally in accordance with the type of recording medium and recording liquid.

SUMMARY OF THE INVENTION

The present invention has been contrived in view of such circumstances, and an object thereof is to provide an image forming apparatus which can perform high-quality image recording through preventing smearing by controlling the permeation velocity of droplets of recording liquid with respect to the recording medium to an optimum velocity in accordance with the type of recording medium and recording liquid (ink).

In order to attain the aforementioned object, the present invention is directed to an image forming apparatus, comprising: a droplet ejection head which ejects a droplet of a liquid having electrorheological properties toward a recording medium; an electric field application device which applies an electric field to the droplet deposited on the recording medium; a recording medium type determining device which determines a type of the recording medium; and an electric field intensity controller which controls intensity of the electric field applied to the droplet deposited on the recording medium by the electric field application device, in accordance with a determination result for the recording medium obtained through the recording medium type determining device, in such a manner that a permeation velocity into the recording medium of the droplet deposited on the recording medium becomes a prescribed permeation velocity.

According to the present invention, since the ink droplets deposited on the recording medium are controlled to a prescribed ink permeation velocity in accordance with the type of recording medium, it is possible to prevent smearing of ink on the recording medium and to achieve optimum image formation in accordance with the type of recording medium.

Preferably, if there are different deposited droplet volumes in an image, the prescribed permeation velocity is established with reference to a representative deposited droplet volume which is a prescribed representative value for that image. Thereby, it is possible to reduce the control load, even in the case of a complicated image. More preferably, the representative deposited droplet volume is a minimum deposited droplet volume. Thereby, it is possible to achieve the highest image quality by determining a representative value under the most rigorous conditions.

Preferably, if the recording medium type determined by the recording medium type determining device is a permeable fixing type of medium in which the droplet of the liquid permeates into an image receiving layer inside the recording medium and a coloring material becomes fixed inside the image receiving layer, then the electric field intensity controller performs control in such a manner that the droplet deposited on the recording medium permeates into the recording medium in a state where viscosity of the droplet is low. According to this, in the case of a permeable fixing type of recording medium which allows the liquid droplets to permeate and become fixed in an image receiving layer, since there is no smearing within the image receiving layer, no electric field is applied and the droplets are caused to permeate rapidly into the medium in a state where the viscosity of the droplets is low.

Preferably, the liquid is a radiation-setting type of liquid; the image forming apparatus further comprises a radiation irradiating device which irradiates radiation onto the droplet deposited on the recording medium so as to harden and fix the droplet on the recording medium; and with respect to the droplet having been deposited on the recording medium, the electric field is applied by the electric field application device and the radiation is irradiated by the radiation irradiating device.

According to the present invention, it is possible to increase the viscosity of the droplets and reduce the permeation velocity thereof by applying an electric field. Consequently, the droplets situated on the surface of the recording medium can be caused to harden on the surface of the recording medium by irradiating radiation, and hence smearing of the droplets can be prevented effectively.

Preferably, if the type of the recording medium determined by the recording medium type determining device is a surface fixing type of medium in which the droplet of the liquid principally hardens on a surface of the recording medium and a coloring material ultimately becomes fixed on the surface of the recording medium, then the electric field intensity applied by the electric field application device to the droplet is controlled by the electric field intensity controller in such a manner that a viscosity of the droplet having been deposited on the recording medium is increased and a permeation velocity becomes such that, of a deposited droplet volume, a droplet volume of a prescribed ratio or less permeates into the recording medium before the liquid hardens completely on the recording medium by the irradiation.

Accordingly, if the recording medium is a surface fixing type of medium in which the liquid droplets harden and become fixed on the surface of the recording medium, then the permeation velocity of the droplets is controlled in such a manner that the volume of the droplet that permeates into the medium before the droplet is hardened by irradiating radiation is equal to or less than a prescribed ratio, and hence the droplets can be hardened and fixed in such a manner that the level of smearing is restricted within a tolerable range.

Preferably, the prescribed ratio is set according to the type of recording medium. According to this, it is possible to establish an optimum allowable permeation velocity, according to the type of recording medium.

Preferably, the prescribed ratio is 30%. Thereby, it is possible to handle the majority of types of recording medium.

Preferably, the electric field intensity controller comprises: a permeation velocity calculating unit which calculates the prescribed permeation velocity according to irradiation energy irradiated by the radiation irradiating device, the conveyance velocity at which the recording medium is conveyed relatively to the droplet ejection head, and the deposited droplet volume; a first storage unit which stores correlation data for liquid viscosity and permeation velocity; a second storage unit which stores correlation data for electric field intensity and liquid viscosity; and an electric field intensity calculating unit which calculates an electric field intensity, wherein the electric field intensity calculating unit calculates a prescribed electric field intensity according to the prescribed permeation velocity calculated by the permeation velocity calculating unit, the correlation data in the first storage unit and the correlation data in the second storage unit. According to this, by storing and establishing data previously, it is possible to calculate the desired electric field intensity readily.

Alternatively, the electric field intensity controller comprises: a permeation velocity calculating unit which calculates the prescribed permeation velocity according to irradiation energy irradiated by the radiation irradiating device, the conveyance velocity at which the recording medium is conveyed relatively to the droplet ejection head, and the deposited droplet volume; and an electric field intensity calculating unit which calculates a prescribed electric field intensity according to correlation data relating electric field intensity applied to the droplet with respect to permeation velocity of the droplet into the recording medium, as determined according to a type of the liquid and the type of the recording medium. According to this, it is possible to apply an optimum electric field, by taking account of the relationship between the recording medium and the permeation velocity.

As described above, according to the image forming apparatus of the present invention, it is possible to perform high-quality image recording through preventing smearing by controlling the permeation velocity of a recording medium (ink) into a recording medium to an optimum velocity in accordance with the type of recording medium and the type of ink.

Furthermore, in particular in the case of a surface fixing type of recording medium, by using a radiation-setting type of ink and controlling the permeation velocity of the ink in such a manner that the volume of ink that has permeated when setting of the ink on the surface of the recording medium is completed is equal to or less than a prescribed ratio, it is possible to cause the ink to set on the surface of the recording medium in such a manner that the level of smearing is restricted within an allowable range, and hence high-quality images can be formed.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Below, an image forming apparatus according to the present invention is described in detail with reference to the accompanying drawings. The image forming apparatus according to the present embodiment prevents smearing of recording dots in such a manner that an optimum image is formed, by controlling the velocity of permeation into recording paper of recording dots deposited on the recording paper, in accordance with the recording medium (image receiving layer) used.

Figure 1:
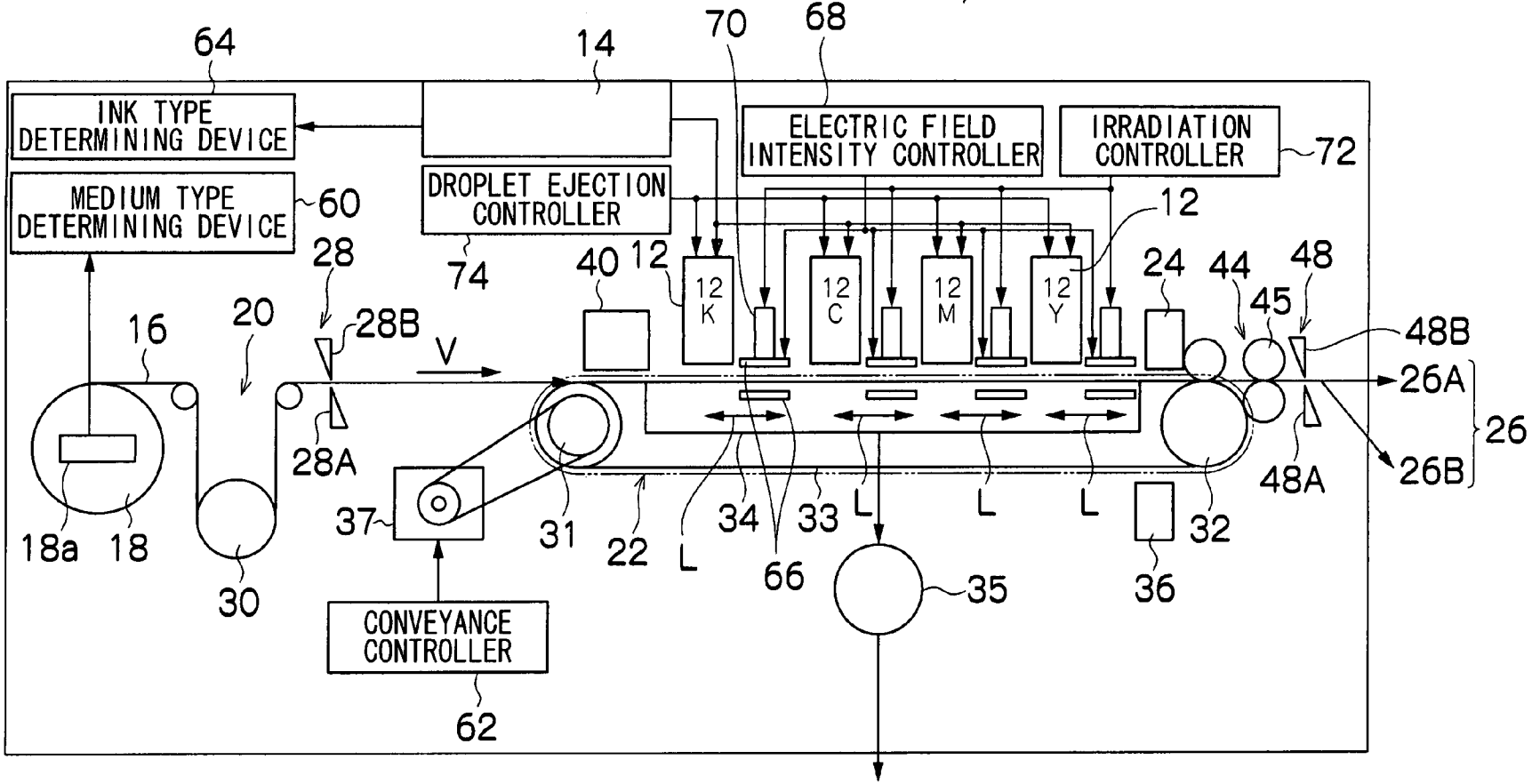
FIG. 1 is a general compositional diagram showing an inkjet recording apparatus relating to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of droplet ejection heads or print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the (photographic) printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

An information recording medium 18*a* such as a bar code and a wireless tag containing information about the type of paper is attached to the magazine of the paper supply unit 18. By reading the information contained in the information recording medium 18*a* with a predetermined reading device, the type of paper to be used is automatically determined, and ink-droplet ejection is controlled so that the ink-droplets are ejected in an appropriate manner in accordance with the type of paper. In addition, though a specific structural example is described later, the penetration velocity of ink-dots deposited on the paper is controlled appropriately in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor 37 being transmitted to at least one of the rollers 31 and 32 (for example, the motive force of the motor 37 is transmitted to the roller 31 in FIG. 1), which the belt 33 is set around, and the recording paper 16 held on the belt 33 is conveyed from left to right in FIG. 1. A conveyance controller 62 controls the drive of the motor 37 to set a conveyance velocity V, which is used in calculation for an optimum permeation velocity of recording dots, as described later.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The printing unit 12 forms a so-called full-line head in which a line head having a length that corresponds to the maximum paper width is disposed in the main scanning direction perpendicular to the delivering direction of the recording paper 16. As a specific structural example is described later, in the printing unit 12, each of the black print head 12K, the cyan print head 12C, the magenta print head 12M, and the yellow print head 12Y in the printing unit 12 is composed of a line head, in which a plurality of ink-droplet ejection apertures (nozzles) are arranged along a length that exceeds at least one side of the maximum-size recording paper 16 intended for use in the inkjet recording apparatus 10.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12C, 12M, and 12Y for the respective colors, and the ejection of each head is determined. The ejection determination includes the presence of the ejection, measurement of the dot size, and measurement of the dot deposition position. The print determination unit 24 is provided with a light source to illuminate the deposited dots.

A heating/pressurizing unit 44 is disposed following the print determination unit 24. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, a sorter for collecting prints according to print orders is provided to the paper output unit 26 for the target prints.

Furthermore, as described in detail below, the inkjet recording apparatus 10 according to the present embodiment uses a radiation-setting type of ink, such as ultraviolet-setting ink (UV ink) or electron beam-setting ink (EB ink), which has been imparted with electrorheological properties, depending on the type of recording paper 16 used. By applying a voltage to the ink, thereby changing the viscosity of the ink and controlling the permeation velocity of the ink with respect to the recording paper 16 to an optimum velocity, the inkjet recording apparatus prevents smearing of the ink. In order to achieve this, the apparatus has the following composition in addition to that described previously. Here, the "radiation" referred to in "radiation-setting ink" includes electromagnetic rays, such as ultraviolet light (UV), and particle rays, such as an electron beam.

More specifically, the inkjet recording apparatus 10 comprises, in addition to the foregoing, an ink type determining device 64, electrodes 66 forming an electric field applying device for applying an electric field to the ink that has deposited onto the recording paper 16, an electric field intensity controller 68 for controlling the electrodes 66, a UV light source 70 forming a photopolymerization irradiating device for hardening and fixing ink deposited on the recording paper 16 by irradiating ultraviolet light onto the ink, and an irradiation controller 72 for controlling the UV light source 70. The electrodes 66 and the UV light source 70 are disposed on the downstream side of each of the print heads 12K, 12C, 12M and 12Y. Furthermore, a droplet ejection controller 74 is provided in order to control the droplet ejection interval (droplet ejection timing) depending on the type of recording paper 16, in such a manner that the ink permeates and becomes fixed rapidly while the ink viscosity is low, and hence there is no landing interference (color mixing) between adjacent recording dots. The determining device and controller, and the like, are described in detail hereinafter.

Next, the structure of the droplet ejection heads or the print heads is described. The print heads 12K, 12C, 12M, and 12Y provided for the respective ink colors have the same structure, and a reference numeral 50 is hereinafter designated to any of the print heads 12K, 12C, 12M, and 12Y as shown in FIG. 2.

Figure 2:
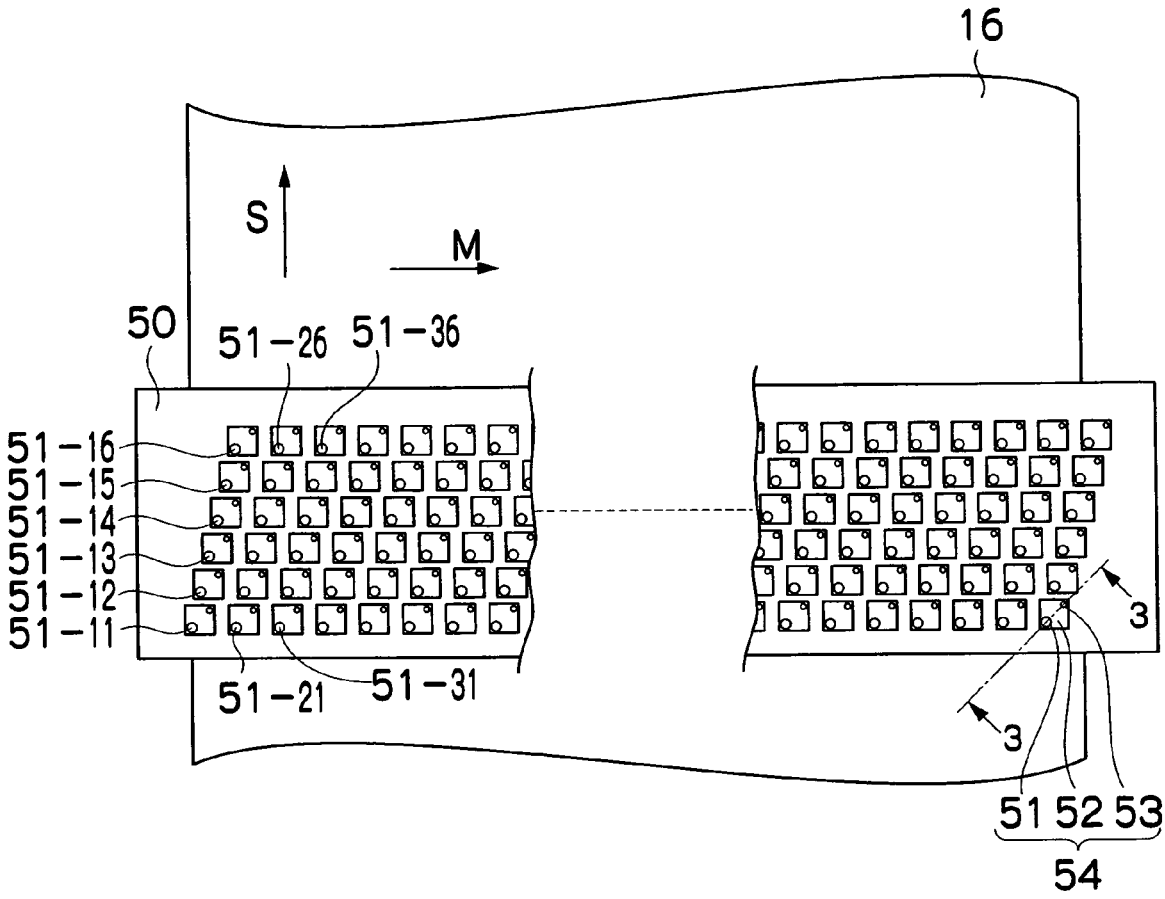
FIG. 2 is a plan perspective diagram showing the structure of a print head.

FIG. 2 is a perspective plan view showing an example of the configuration of the print head 50. As shown in FIG. 2, the print head 50 has a structure in which a plurality of ink chamber units 54 including nozzles 51 for ejecting ink-droplets and pressure chambers 52 connecting to the nozzles 51 are two-dimensionally disposed in the form of a staggered matrix.

As shown in FIG. 2, the planar shape of the pressure chamber 52 provided for each nozzle 51 is substantially a square, and the nozzle 51 and ink supply port 53 are disposed in both corners on a diagonal line of the square. Each pressure chamber 52 is connected to a common channel (not shown in FIG. 2) through the ink supply port 53.

FIG. 2 is a plan perspective diagram, and the nozzles 51 are open toward the rearward direction in the drawing sheet. Ink is ejected from the nozzles 51 (in the rearward direction in the drawing sheet) toward recording paper 16 which is conveyed below the print head 50 in the direction of the arrow S in the diagram. Furthermore, as shown in FIG. 2, the print head 50 is a line head which is able to handle the maximum paper width of the recording paper 16, the lengthwise direction of the print head 50 being the direction indicated by the arrow M, which is perpendicular to the conveyance direction of the recording paper 16 (the direction indicated by arrow S).

The print unit 12 which is provided with the full-line heads covering the entire width of the recording paper 16 as the print head 50, can record an image over the entire surface of the recording paper 16 by performing the action of moving the recording paper 16 and the print unit 12 relatively to each other in the sub-scanning direction represented by the arrow S in FIG. 2 just once (i.e., a single sub-scan). Higher-speed printing is thereby made possible and productivity can be improved in comparison with a shuttle type head configuration in which a print head reciprocates in the direction perpendicular to the delivering direction of the recording paper 16, represented by the arrow M in FIG. 2 (i.e. the main scanning direction).

In addition, here is described about "main scanning" and "sub-scanning". The "main scanning" and "sub-scanning" are methods for moving nozzle of the print head, and are defined as following.

In a full-line head comprising rows of nozzles that have a length corresponding to the maximum width of the paper (the recording paper 16), the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 2 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording paper 16 (the direction of the arrow M perpendicular to the conveyance direction, i.e. the main scanning direction) by sequentially driving the nozzles 51-11, 51-12, . . . , 51-16 in accordance with the conveyance velocity of the recording paper 16, while conveying the recording paper 16 in the direction of the allow S.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

Figure 3:
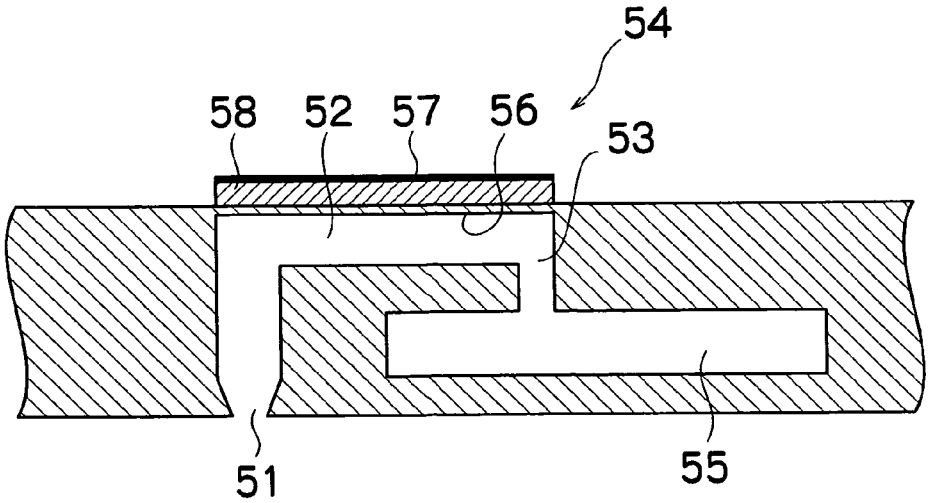
FIG. 3 is a cross-sectional view along line 3-3 in FIG. 2.

FIG. 3 is a cross-sectional view taken along the line 3-3 in FIG. 2, showing the inner structure of an ink chamber unit 54.

As shown in FIG. 3, in the pressure chamber unit 54, an actuator 58 having an individual electrode 57 is joined to a pressure plate 56 which forms the ceiling of the pressure chamber 52, and the actuator 58 is deformed by applying drive voltage to the individual electrode 57 to eject ink from the nozzle 51.

When ink is ejected, new ink is delivered from the common flow channel 55 through the ink supply port 53 to the pressure chamber 52.

Figure 4:
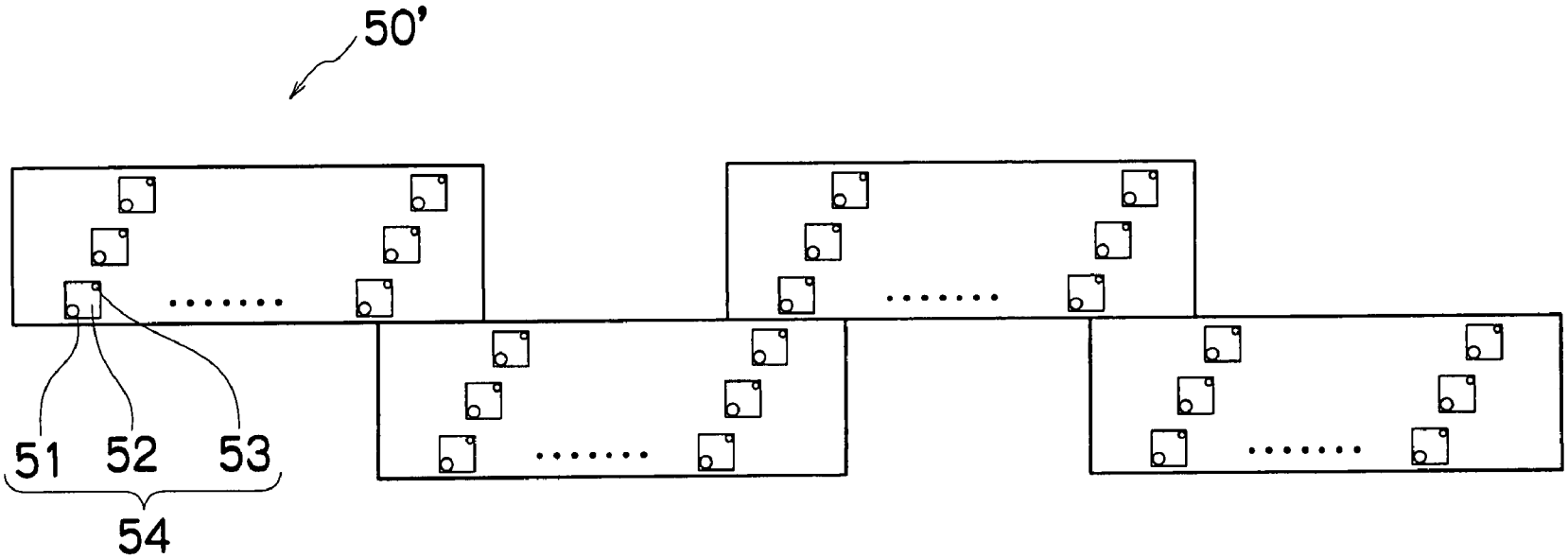
FIG. 4 is a plan view perspective diagram showing a further example of the structure of a print head.

As shown in FIG. 2, the print head 50 in the present embodiment is described as a full-line head in which one or more of nozzle rows in which the nozzles 51 (the pressure chamber unit 54) are arranged in a two-dimensional matrix. Alternatively, as shown in FIG. 4, a full-line head may be composed of a plurality of short two-dimensionally arrayed head units 50' arranged in the form of a staggered matrix and combined so as to form nozzle rows having lengths that correspond to the entire width of the recording paper 16.

Figure 5:
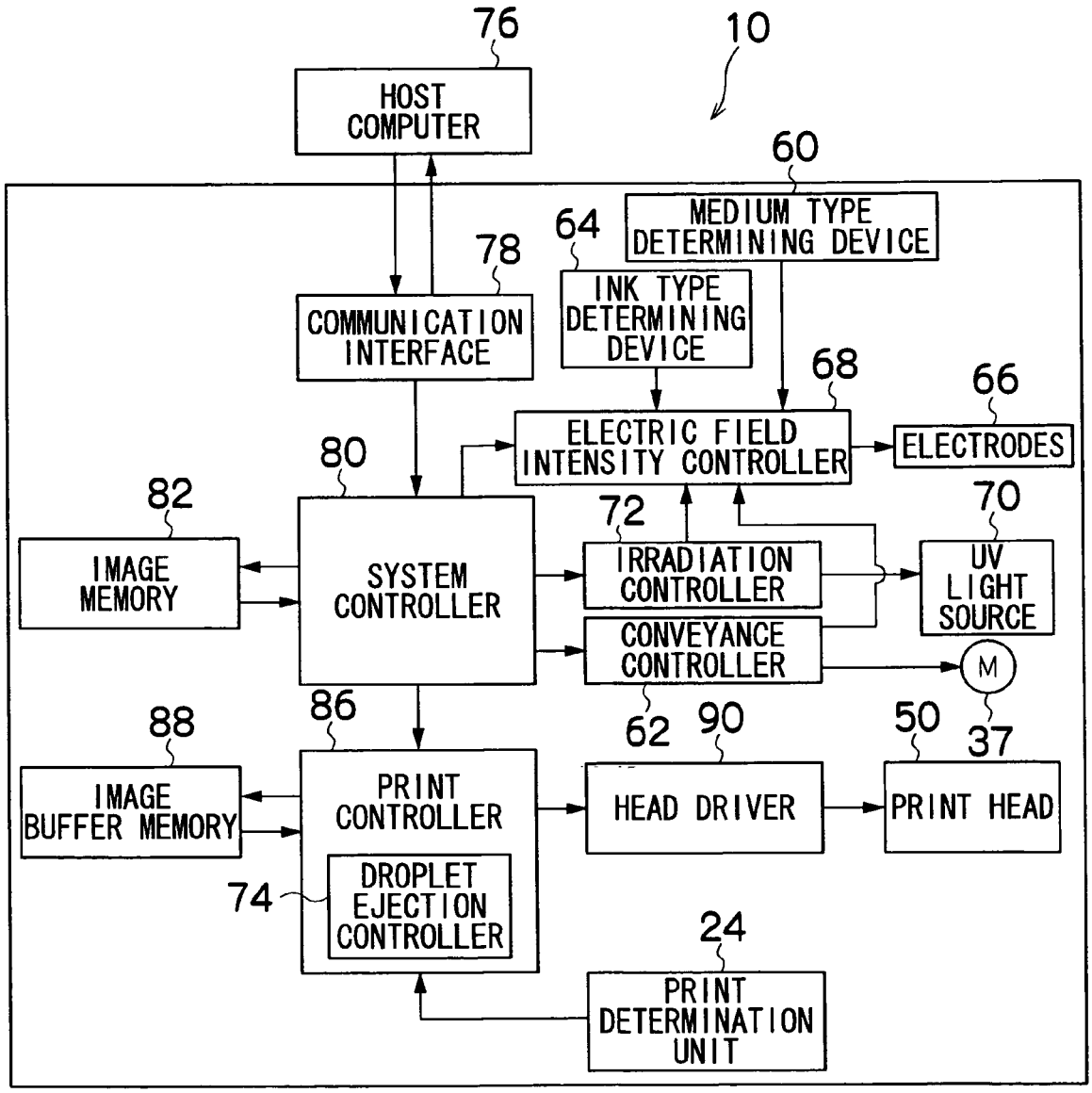
FIG. 5 is a principal block diagram showing the system composition of the inkjet recording apparatus.

FIG. 5 is a block diagram of the principal components showing the system configuration of the inkjet recording apparatus 10. The inkjet recording apparatus 10 has a communication interface 78, a system controller 80, an image memory 82, the conveyance controller 62, a print controller 86, an image buffer memory 88, a head driver 90, and other components.

The communication interface 78 is an interface unit for receiving image data sent from a host computer 86. A serial interface such as USB, IEEE1394, Ethernet, wireless network, or a parallel interface such as a Centronics interface may be used as the communication interface 78. A buffer memory (not shown) may be mounted in this portion in order to increase the communication speed. The image data sent from the host computer 76 is received by the inkjet recording apparatus 10 through the communication interface 78, and is temporarily stored in the image memory 82. The image memory 82 is a storage device for temporarily storing images inputted through the communication interface 78, and data is written and read to and from the image memory 82 through the system controller 80. The image memory 82 is not limited to memory composed of a semiconductor element, and a hard disk drive or another magnetic medium may be used.

The system controller 80 controls the communication interface 78, image memory 82, conveyance controller 62, and other components. The system controller 80 has a central processing unit (CPU), peripheral circuits therefore, and the like. The system controller 80 controls communication between itself and the host computer 86, controls reading and writing from and to the image memory 82, and also generates control signals for controlling the motor 37 in the conveyance system. The conveyance controller 62 controls the drive of the motor 37 according to the command given by the system controller 80.

The print control unit 86 is a control unit having a signal processing function for performing various treatment processes, corrections, and the like, in accordance with the control implemented by the system controller 80, in order to generate a signal for controlling printing, from the image data in the image memory 82. Prescribed signal processing is carried out in the print control unit 86, and the ejection amount and the ejection timing of the ink droplets from the respective print heads 50 are controlled via the head driver 90, on the basis of the image data. By this means, prescribed dot sizes and dot positions can be achieved.

The print controller 86 is provided with the image buffer memory 88; and image data, parameters, and other data are temporarily stored in the image buffer memory 88 when image data is processed in the print controller 86. The aspect shown in FIG. 4 is one in which the image buffer memory 88 accompanies the print controller 86; however, the image memory 82 may also serve as the image buffer memory 88. Also possible is an aspect in which the print controller 86 and the system controller 80 are integrated to form a single processor.

Furthermore, in addition to the foregoing, the inkjet recording apparatus 10 according to the present embodiment comprises: a medium type determining device 60 for determining the type of recording paper 16; the ink type determining device 64 for determining the type of ink; the electric field intensity controller 68 for controlling the electrodes 66 to change the viscosity of the ink by applying an electric field to the ink which has electrorheological properties; the irradiation controller 72 for controlling the UV light source 70 which irradiates UV light onto the UV ink, which is the radiation-setting ink, and the droplet ejection controller 74 for controlling the droplet ejection timing in such a manner that there is no color mixing between adjacently positioned recording dots.

These respective determining devices and controllers are controlled by the system controller 80, and in particular, the droplet ejection controller 74 is provided inside the print controller 86.

When the type of recording medium (recording paper 16) is a surface fixing type of medium, and the ink used is a UV-setting ink having electrorheological properties, then the inkjet recording apparatus 10 according to the present embodiment performs UV setting of ink droplets when the droplets are situated on the surface of the recording medium, thus preventing smearing of the ink, by applying an electric field to the ink deposited onto the recording medium so as to change the viscosity of the ink (namely, so as to increase the viscosity of the ink). On the other hand, if the type of recording medium is a permeable fixing type of medium, then the inkjet recording apparatus 10 prevents landing interference by omitting to apply an electric field and thereby causing the ink that has landed on the recording medium to permeate and become fixed in the medium rapidly while the ink viscosity is low, and furthermore, by controlling the droplet ejection timing (droplet ejection interval) between adjacently positioned recording dots.

Here, a surface fixing type medium is a recording medium where the ink principally hardens on the surface of the medium and the pigment ultimately becomes fixed on the surface of the medium. One example of such a recording medium is standard paper. In the case of a surface fixing type medium, rather than all of the ink permeating into the recording medium, only a portion of the ink permeates into the medium. Furthermore, a permeable fixing type medium is a recording medium where the ink permeates into an image receiving layer inside the recording medium and the pigment (solute) ultimately becomes fixed in the image receiving layer. An example of such a recording medium is special inkjet paper. In this case, if a water-based ink is used, the water solvent eventually evaporates by drying.

As described above, the type of recording medium (recording paper 16) is determined by the medium type determining device 60 by reading in information from the information recording medium 18*a* attached to the magazine of the paper supply unit 18. The ink type is determined by the ink type determining device 64. The determination method is not limited in particular, and various types of methods may be adopted. For example, similarly to the recording medium, it is also possible to read in ink type information attached to the ink tanks loaded into the ink storing and loading unit 14, and it also possible for the operator to input the information separately.

Furthermore, the electrorheological ink used here is ink which displays an electrorheological effect whereby the apparent viscosity of the ink increases instantaneously when an electric field (voltage) is applied. The viscosity change is reversible by switching the electric field on and off. There are two types of electrorheological fluids which display an electrorheological effect of this kind: dispersed and uniform fluids.

A dispersed type fluid is one in which dielectric micro-particles are dispersed in an electrically insulating solvent. This fluid behaves in such a manner that when no electric field is applied, the micro-particles remain in a dispersed state and the viscosity of the fluid is low, but when an electric field is applied, the polarized particles form chain-like structures ("bridges") linked in the direction of the electric field, and these bridges act so as to increase the viscosity of the fluid. Dispersed type electrorheological fluids include aqueous and non-aqueous fluids.

Furthermore, uniform type electrorheological fluids are fluids having anisotropic properties in which molecules or domains are oriented in the direction of the electric field, such as liquid crystals, or the like. Since uniform type electrorheological fluids currently display little change in viscosity, it is thought that dispersed type electrorheological fluids are more suitable for use in inkjet printers.

Moreover, in the present embodiment, a radiation-setting type of ink (such as UV-setting ink) is used, and electrorheological properties are imparted to this ink. A radiation-setting ink thereby imparted with electrorheological properties may be created, for example, by dispersing solid micro-particles (silica gel, starch, dextrin, carbon, gypsum, gelatin, alumina, cellulose, mica, zeolite, kaolite, or the like) in a liquid containing at least a radiation-setting monomer and a polymerization initiator; by using the actual pigment micro-particles as a dispersant for creating an electrorheological effect; by forming the dye or pigment into micro-capsules, providing insulation on the surface thereof, and using these micro-capsules as a dispersant for creating an electrorheological effect; or by combining a uniform type electrorheological fluid.

If the recording medium is a surface fixing type of medium, then the ink deposited onto the medium becomes fixed on the surface of the medium, and in order to prevent smearing, the permeation velocity is controlled in such a manner that the deposited ink does not permeate by more than a prescribed amount into the recording medium. Here, the permeation velocity of the ink is defined with the volume of the ink droplet that permeates into the recording medium per unit time, when an ink droplet that has been deposited on the recording medium permeates into that recording medium.

The permeation velocity is controlled by controlling the ink viscosity through controlling the intensity of the electric field applied by the electrodes 66 to ink having electrorheological properties that has been deposited on the recording paper 16. In this case, the electric field intensity controller 68 calculates an optimum permeation velocity and controls the intensity of the electric field applied by the electrodes 66 in such a manner that the ink is set to a viscosity corresponding to this optimum velocity.

In the example shown in FIG. 1, the electrodes 66 which applies an electric field are situated on the downstream side of the print unit 12, and it applies an electric field after the ink droplets have landed on the medium, but it is also possible to provide electrodes 66 on the upstream side of the print unit 12, in such a manner that an electric field is applied to the recording paper 16 before the ink lands thereon. However, in this case, the ink inside the nozzles 51 may receive the effects of the electric field and increase in viscosity, possibly leading to nozzle blockages, and therefore it is preferable to situate the electrodes 66 on the downstream side as shown in FIG. 1.

It is also possible to provide a de-charging device on the downstream side of the electrodes 66. In is thereby possible to prevent the recording paper 16 from becoming charged and becoming difficult to separate from the belt 33, which might lead to conveyance problems. Furthermore, rather than installing a special de-charging device, it is also possible, for example, to combine the de-charging device in the conveyance rollers, or the like, by making the conveyance rollers electrically conductive in such a manner that the charge is removed naturally during conveyance.

Furthermore, if the recording medium is a permeable fixing type of medium, then no electric field is applied in order that the viscosity remains low and the ink rapidly permeates and becomes fixed in the medium. In this case, the droplet ejection timing is controlled by the droplet ejection controller 74 in order to prevent landing interference between adjacently positioned recording dots.

Next, the electric field intensity control and droplet ejection timing control will be described. Firstly, the electric field intensity control performed by the electric field intensity controller 68 will be described.

Figure 6:
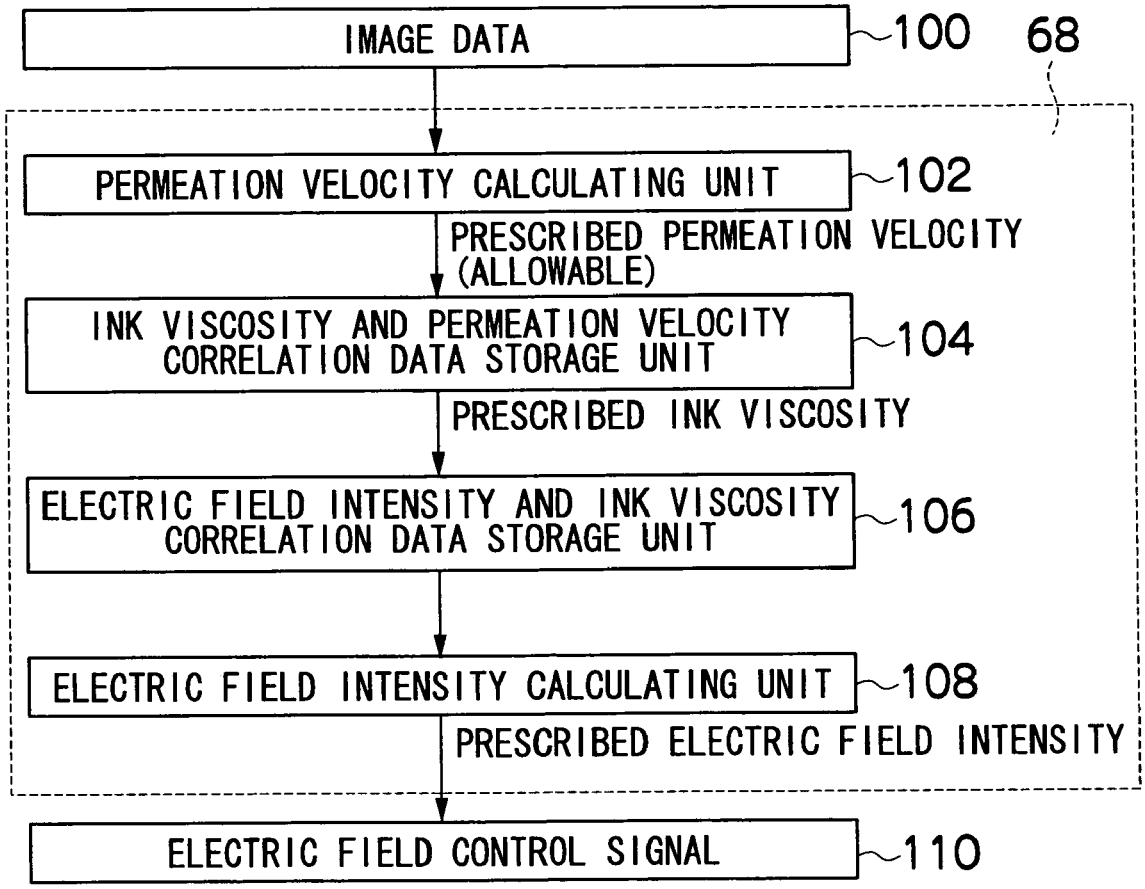
FIG. 6 is a block diagram showing the detailed composition of an electric field intensity controller.

FIG. 6 is a block diagram showing details of the composition of the electric field intensity controller 68. As shown in FIG. 6, the electric field intensity controller 68 is constituted by a permeation velocity calculating unit 102, an ink viscosity and permeation velocity correlation data storage unit (first storage unit) 104, an electric field intensity and ink viscosity correlation data storage unit (second storage unit) 106 and an electric field intensity calculating unit 108.

The permeation velocity calculating unit 102 calculates a desired optimum permeation velocity from the UV irradiation (photopolymerization) energy value, the conveyance velocity of the recording medium, and the volume of the ink droplet deposited on the medium. Therefore, when the permeation velocity calculating unit 102 receives the image data from the image memory 82 via the system controller 80, the permeation velocity calculating unit 102 calculates the volume of the deposited ink droplet from this data, while also acquiring the UV irradiation energy value from the irradiation controller 72, and the conveyance velocity of the recording medium from the conveyance controller 62.

Figure 7A:
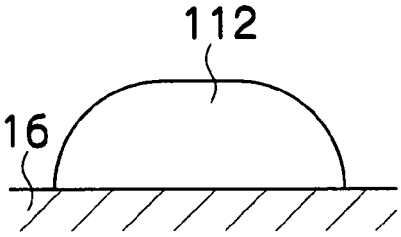
FIGS. 7A and 7B show cross-sectional diagrams of an ink droplet that has landed on recording paper, in a state after landing and a state after setting, respectively.
Figure 7B:
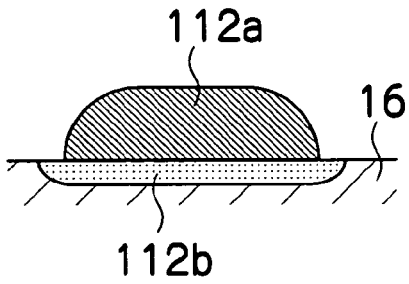

Here, an ink droplet 112 that has landed on the recording paper 16 must complete UV setting while it is situated on the surface of the recording paper 16, as illustrated in FIG. 7A. Therefore, the optimum value of the ink permeation velocity is desirably set to a velocity whereby the volume of ink 112*b* that permeates into the recording paper 16 during the time period from the landing of the ink to the completion of UV setting, as illustrated in FIG. 7B, is 30% or less of the volume of the ink droplet 112 that landed on the paper in FIG. 7A, and the volume of ink 112*a* remaining on the surface of the recording paper 16 is 70% or more of the volume the ink droplet 112 that landed on the paper.

The following Table 1 shows the results of observation and evaluation of ink smearing in a case where the ratio of the ink 112*b* permeating into the recording paper 16, from the ink droplet 112, is changed variously by controlling the permeation velocity of the ink.

TABLE 1

| Ratio of permeated ink volume to deposited ink volume (%) | Results of observation of smearing | Evaluation |
|---|---|---|
| 15 | Virtually no smearing observed, even with 10× magnifying glass | Excellent |
| 20 | No smearing observed | Good |
| 25 | No smearing observed | Good |
| 30 | Virtually no smearing observed | Good |
| 35 | Slight smearing observed | Fair |
| 40 | Significant level of smearing observed | Poor |
| 45 | Significant level of smearing observed | Poor |

As shown in Table 1, if the ratio of the permeated ink to the total of deposited ink is 30% or less, then no smearing is observed. In particular, if the ratio of the permeated ink is 15%, then virtually no smearing is observed, even using a magnifying glass with a 10× magnification factor. On the other hand, it can be seen that if the ratio of the permeated ink volume exceeds 30%, then smearing starts to be observed, and the higher the ratio of the permeated ink, the greater the degree of smearing that occurs.

It is hence possible to reduce smearing to a negligible level, by setting the volume of the ink 112*b* that permeates into the recording paper 16 to 30% or less of the volume of the ink droplet 112 deposited on the paper. More desirably, the volume of the permeating ink 112*b* is set to 15% or less of the volume of the ink droplet 112 deposited on the paper.

An optimum permeation velocity Vo(pl/sec) of this kind can be calculated in the following way. Here, the deposited volume of a representative ink droplet in the image, as calculated from the image data, is taken as Vd(pl), the conveyance velocity of the recording medium read out from the conveyance controller 62 is taken as V(mm/sec), the distance from the landing position of the ink shown in FIG. 1 to the position where it completes setting (substantially equal to the distance from the print unit 12 to the end of the UV light source 70) is taken as L(mm), and the time period from landing of the ink until completion of setting by the UV light source 70 is taken as tc(sec). Here, the parameters L and V are set in such a manner that tc<LV. Here, tc is a function, tc=f(E, V, Vd), and hence is determined by the UV irradiation energy E, the conveyance velocity V and the volume of the deposited ink droplet Vd.

Accordingly, the allowable permeation velocity Vo for the ink, at which the volume of ink permeating into the recording paper 16 will be 30% or less of the volume of the ink droplet deposited onto the paper, is calculated by the following equation (1):

$$Vo=0.3\times Vd/tc. \quad (1)$$

Therefore, the electric field intensity is preferably controlled in such a manner that an optimum permeation velocity of Vo=0.3×Vd/tc or less is achieved.

In the foregoing calculation, the deposited volume of a representative ink droplet in the image, Vd, is used as the volume of the deposited ink droplet, in order to take account of cases where ink droplets of a variety of different volumes are deposited in the same image. By this means, the control load can be reduced, even in the case of complicated images.

Figure 8:
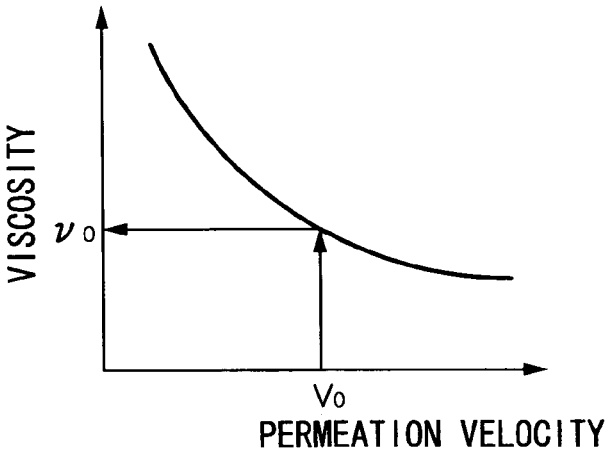
FIG. 8 is a graph showing the correlation between viscosity and permeation velocity.
Figure 9:
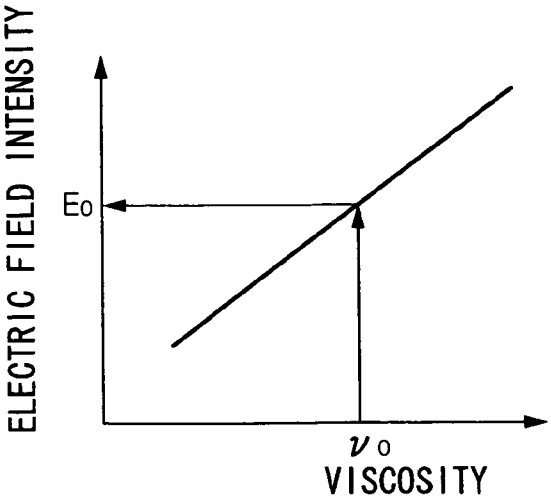
FIG. 9 is a graph showing the correlation between electric field intensity and viscosity.

The ink viscosity and permeation velocity correlation data storage unit 104 stores data indicating the correlation between the ink viscosity and the permeation velocity for respective types of recording media and types of ink, as illustrated in FIG. 8. The electric field intensity and ink viscosity correlation data storage unit 106 stores data indicating the correlation between the electric field intensity and the ink viscosity for respective types of ink, as illustrated in FIG. 9. Although the graph in FIG. 9 is linear, it may also be a curve depending on the type of electrorheological fluid used.

On the basis of these data, the electric field intensity calculating unit 108 calculates the electric field intensity required in order to achieve the allowable permeation velocity. More specifically, on the basis of the calculated allowable permeation velocity Vo, an allowable viscosity vo corresponding to this allowable permeation velocity Vo is calculated by using the correlation data between the viscosity and the permeation velocity shown in FIG. 8. Then, a prescribed electric field intensity Eo corresponding to this allowable viscosity vo is calculated by using the correlation data between the electric field intensity and the ink viscosity shown in FIG. 9.

The electric field intensity controller 68 outputs an electric field control signal 110 to the electrodes 66, which form the electric field application device, in order to drive the electrode 66 at (or above) the prescribed electric field intensity Eo thus calculated.

Figure 10:
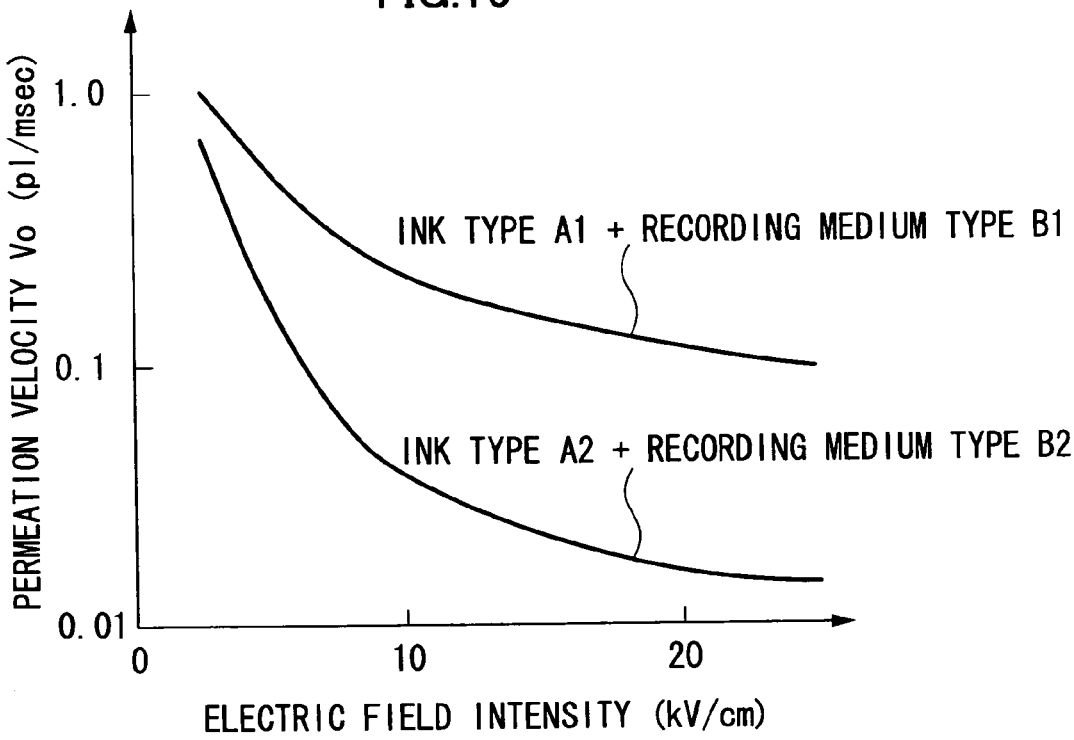
FIG. 10 is a graph showing the correlation between permeation velocity and electric field intensity, for a combination of ink types and recording medium types.

The electric field intensity controller 68 calculates the prescribed electric field intensity corresponding to the allowable permeation velocity, as described above, and it obtains a graph indicating the relationship between the permeation velocity and the electric field intensity, as shown in FIG. 10, for each type of ink and recording medium. Therefore, if correlation data for the permeation velocity and the electric field intensity as illustrated in FIG. 10 is previously stored for each combination of ink type and recording medium type, then the calculating process becomes simple.

Next, if the recording medium is a permeable fixing type of medium, then the ink is allowed to permeate rapidly into the medium in a state of low viscosity, and the droplet ejection controller 74 implements droplet ejection timing control in order to prevent landing interference between dots that are positioned adjacently during image recording. This droplet ejection timing control is now described with reference to FIG. 10 to FIG. 15.

In the inkjet recording apparatus 10, in cases where dots formed onto a permeable fixing type of recording paper 16 are mutually overlapping, the droplet ejection (recording) timing is controlled in such a manner that a succeeding ink droplet 130 (see FIG. 13) is ejected before the preceding ink droplet 120, ejected previously, has permeated completely into the recording paper 16.

Figure 11:
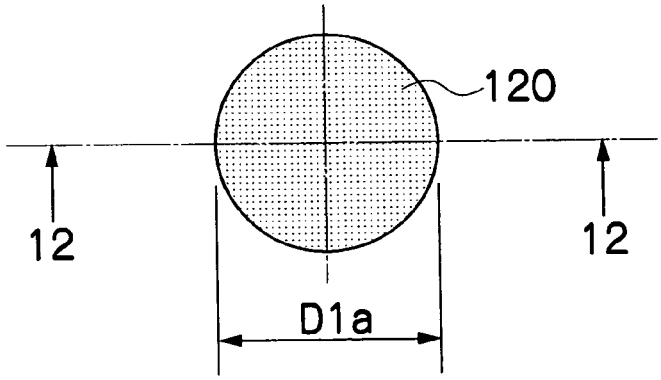
FIG. 11 is a plan view of an ink droplet that has landed on the recording paper, for the purpose of describing droplet ejection control performed by the inkjet recording apparatus according to the present embodiment.

FIG. 11 shows the preceding ink droplet 120, which is ejected first. The diameter of the ink droplet 120 on the surface of the recording paper 16 is D1*a*. If a dye based ink is used, then when the ink droplet 120 lands on the surface of the recording paper 16, it permeates into the image receiving layer of the recording paper 16 (not illustrated) over time, and since this permeation is completed from the outer side toward the inner side of the ink droplet 120, the diameter of the ink droplet gradually decreases toward the center.

When a prescribed time period T has passed, the solvent on the surface of the recording paper 16 has disappeared and the ink droplet 120 has permeated completed into the recording paper 16. Here, a dot of a prescribed size is formed. In the present embodiment, the dot has the same diameter as the diameter of the ink droplet when it lands on the paper. This time period T is taken to be the complete permeation time.

Figure 12:
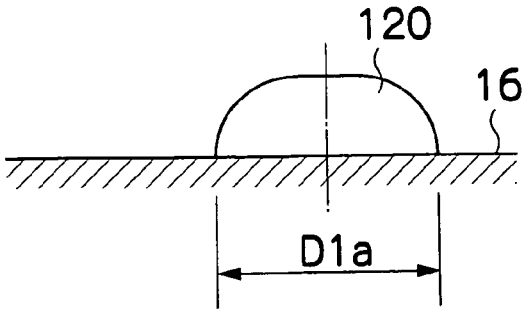
FIG. 12 is a cross-sectional view along line 12-12 in FIG. 11.
Figure 13:
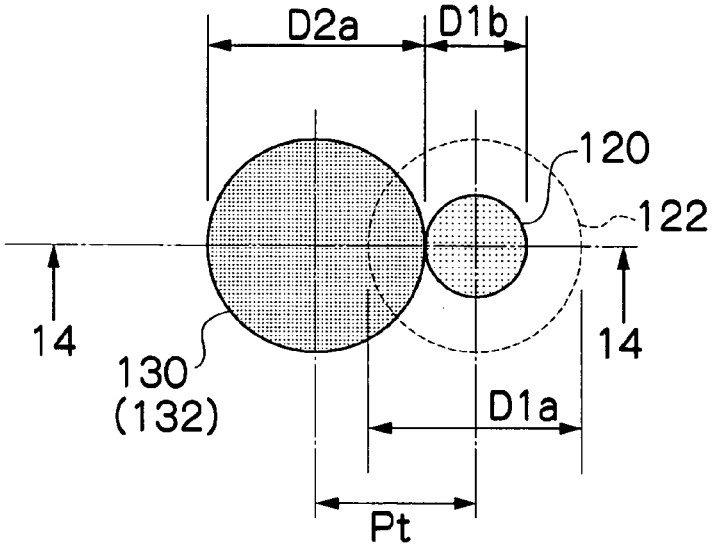
FIG. 13 is a plan view of an ink droplet showing the principal portion of droplet ejection control.

FIG. 12 is a cross-sectional diagram along line 12-12 in FIG. 11, and it shows a state immediately after the ink droplet 120 has landed on the recording paper 16. FIG. 13 shows a state where a prescribed time period, which is less than the complete permeation time T, has elapsed since the ink droplet 120 landed on the recording paper 16. In this state, the diameter of the ink droplet 120 on the surface of the recording paper 16 has become D1*b*.

The circle indicated by the dotted line in FIG. 13 shows the dot 122 that is formed by the ink droplet 120, and its size is approximately the same as that of the ink droplet 120 upon landing on the recording paper 16. More specifically, a dot 122 having a diameter of D1*a* is formed by the ink droplet 120.

Furthermore, FIG. 13 shows a state where an ink droplet 130 of diameter D2*a* has been ejected to form a dot 132 having a dot diameter of D2*a*, at an interval (dot pitch) of Pt from the center of the dot 122.

If the relationship between the diameter D1*b* of the previously ejected ink droplet 120 after a time period δT has elapsed since its landing on the recording paper 16, the diameter D2*a* of the ink droplet 130 upon landing on the recording paper 16, and the interval Pt between the ink droplet 120 and the ink droplet 130 (which corresponds to the dot pitch, being the distance between the centers of the dots formed by the ink droplet 120 and the ink droplet 130), satisfies the following inequality (2):

$$D1b<2\times Pt-D2a, \quad (2)$$

then the ink droplet 120 and the ink droplet 130 do not combine on the surface of the recording paper 16. Therefore, the shapes of the dot 122 and the dot 132 formed respectively by the ink droplet 120 and the ink droplet 130 are not deformed. In FIG. 13, the dot 132 is formed at the same position and to the same size as the ink droplet 130. Therefore, the desired dot shape can be achieved.

Here, the condition for overlapping between the dots 122 and 132 is expressed by the relationship: Pt<(D1*a*/2)+(D2*a*/2). In other words, the condition for overlapping between the dots 122 and 132 is that the sum of the radius of the dot 122 plus the radius of the dot 132 be greater than the dot pitch Pt.

The dot 122 shown in FIG. 13 includes a region where the ink droplet 120 has not permeated into the recording paper 16 (the region illustrated as an ink droplet 120), and a region where the ink droplet 120 has permeated completely into the recording paper 16 and the coloring material of the ink (solute) is held within the image receiving layer of the recording paper 16 (the region of the dot 122 indicated by the broken line, minus the region indicated by the ink droplet 120). Out of these two regions, it is possible to eject another ink droplet 130 so as to land on the region where the ink droplet 120 has permeated completely into the recording paper 16.

Figure 14:
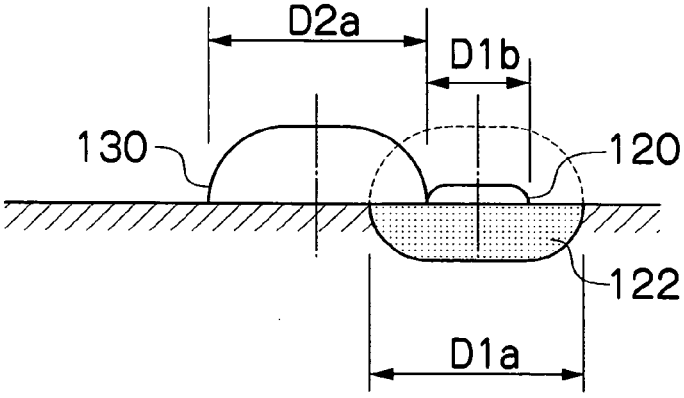
FIG. 14 is a cross-sectional view along line 14-14 in FIG. 13.

FIG. 14 is a cross-sectional diagram (corresponding to FIG. 12) which shows a cross-section of the ink droplet 120 and the ink droplet 130 along line 14-14 in FIG. 13. As the ink droplet 130 permeates into the recording paper 16, the ink droplet 120 and the ink droplet 130 may combine in the image receiving layer of the recording paper 16 in the region of overlap between the dot 122 and the ink droplet 130. However, even if such combination occurs, since the ink droplet 120 has already permeated into the image receiving layer and the coloring material (solute) has been retained in this layer, there will be virtually no change in the shape of the dot 122 within the image receiving layer.

When the aforementioned complete permeation time T has elapsed since the ink droplet 130 landed on the recording paper 16, the ink droplet 130 will have permeated completely into the recording paper 16, and the dot 122 of diameter D1*a* and the dot 132 of diameter D2*a* will have been formed, as shown in FIG. 14.

Figure 15:
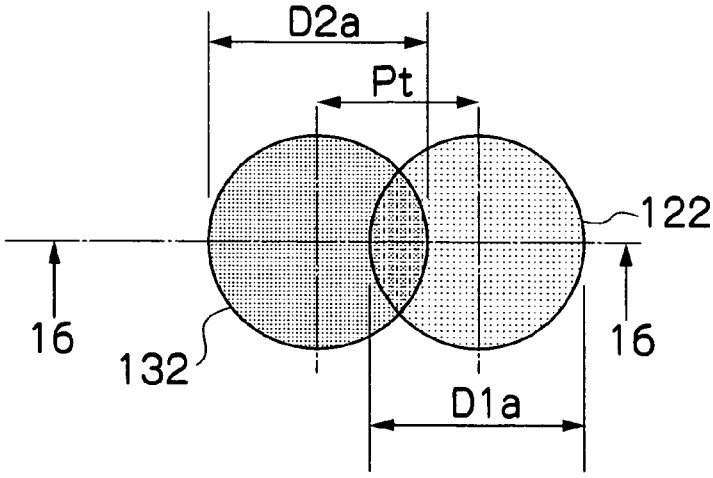
FIG. 15 is a plan view of an ink droplet showing the results of droplet ejection control.
Figure 16:
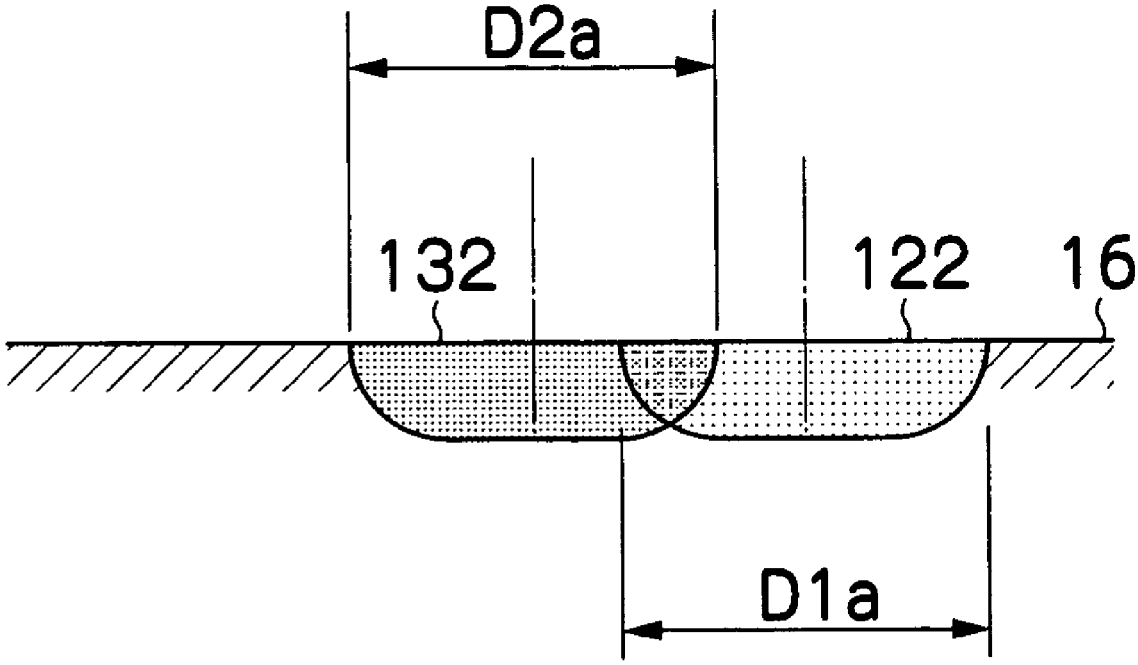
FIG. 16 is a cross-sectional view along line 16-16 in FIG. 15.

FIG. 16 is a cross-sectional diagram showing a cross-section of the dot 122 and the dot 132 viewed along line 16-16 in FIG. 15.

When two dots are to overlap, after ejecting a first ink droplet, it is possible to eject the succeeding ink droplet without having the wait for the complete permeation time T, which is the time period until the previously ejected ink droplet has permeated completely into the paper. Namely, the succeeding ink droplet can be ejected while D1*b* is still greater than 0.

In other words, the value of the diameter D1*b* of the ink droplet 120 that will satisfy the above-described inequality (2) when the ink droplet 130 lands on the paper, is determined from the interval Pt between the preceding ink droplet 120 and the succeeding ink droplet 130 and the diameter D2*a* of the ink droplet 130 upon landing. The diameter D1*b* of the ink droplet 120 thus determined, and the diameter D1*a* of the ink droplet 120 upon landing on the paper, are used to calculate the permeation time δT. The droplet ejection timings for the ink droplet 120 and the ink droplet 130 are controlled by taking the permeation time δT thus determined as the droplet ejection interval.

If the coloring material in the ink has a large molecular structure and is mixed in with a solvent without being dissolved in the solvent (this applies to many pigment-based inks), then when an ink droplet lands on the surface of the recording paper 16, the solvent permeates into the image receiving layer and a portion of the coloring material also permeates into the image receiving layer. However, the majority of the coloring material solidifies on the surface of the paper. The droplet ejection timing control described above may also be applied to a pigment-based ink in which the majority of the coloring material solidifies on the surface of the recording paper 16.

In this case, the permeation of the solvent is completed from the outer side toward the inner side. Therefore, the droplet ejection control method described above can be used suitably in order to prevent combination of respective ink droplets on the surface of the recording paper 16.

Figure 17:
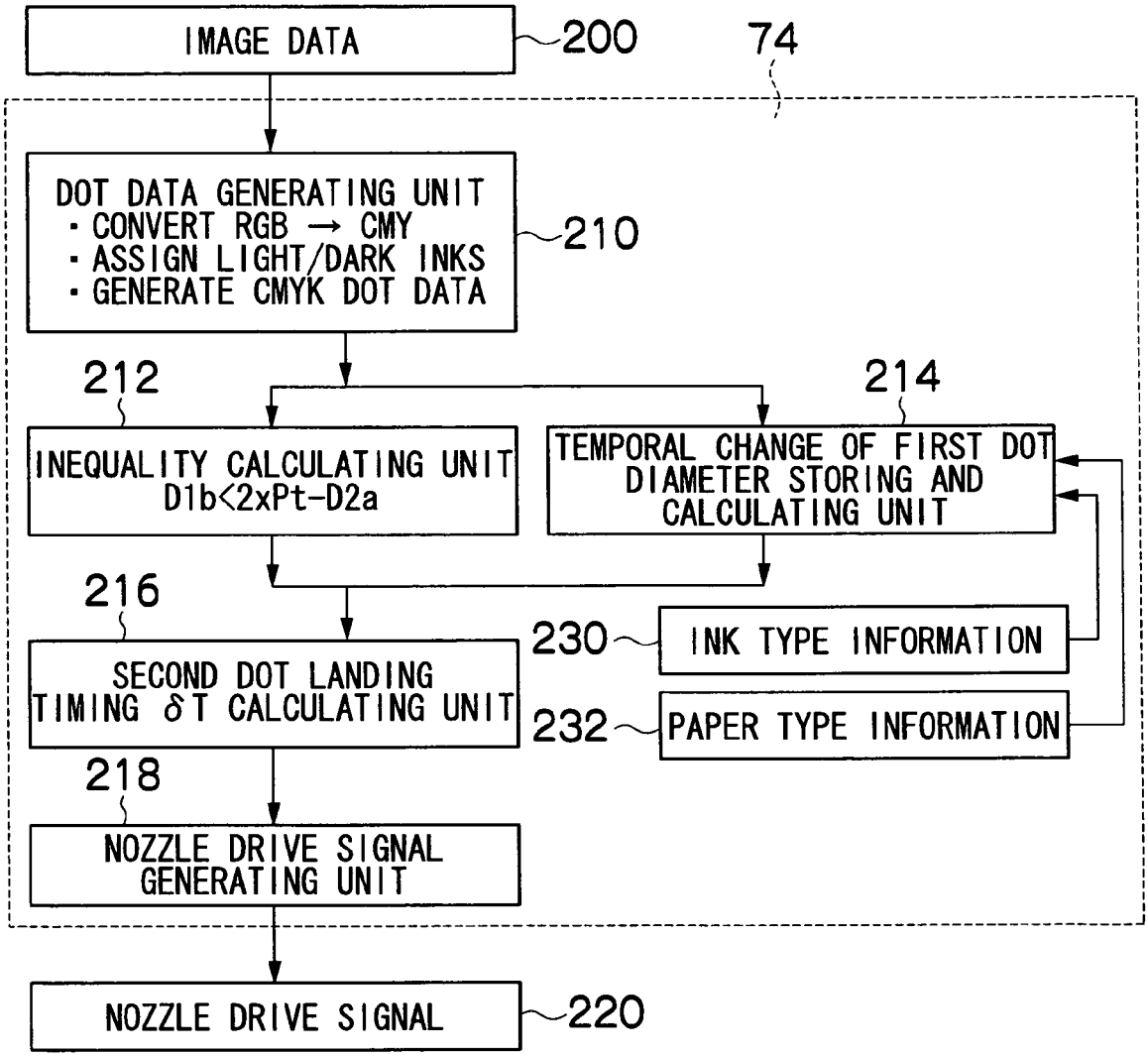
FIG. 17 is a block diagram showing the general composition of a droplet ejection control unit according to the present embodiment.

FIG. 17 is a block diagram showing the detailed composition of a droplet ejection controller 74 for executing the droplet ejection control described above. The droplet ejection controller 74 is contained in the system (print controller 86) shown in FIG. 5.

When image data 200 is obtained from the host computer 76 shown in FIG. 5, a dot data generating unit 210 performs processing for converting the RGB data into CMY data, allocating use of the dark and light inks, and generating CMYK dot data.

Thereupon, an inequality calculating unit 212 determines the diameter D1*b* of the preceding ink droplet (ink droplet 120 in FIG. 15), from the pitch Pt between the two dots (for example, the pitch between the ink droplet 120 and the ink droplet 130 shown in FIG. 15), and the diameter D2*a* of the succeeding ink droplet (the ink droplet 130 in FIG. 15).

Information relating to temporal change in the size of the ink droplets is stored in a dot size calculating and storing unit 214. By referring to this information, a timing calculation unit 216 determines the permeation time 8T until the aforementioned value of D1*b* is reached, from the diameter D1*a* of the preceding ink droplet forming a dot, at the time that it lands on the paper. (In other words, it determines the droplet ejection interval). Furthermore, the timing control parameters in the sub-scanning direction (such as the conveyance velocity of the recording paper), and the timing control parameters in the main scanning direction are determined from this permeation time period δT.

A drive signal 220 for the respective nozzles is generated by a nozzle drive signal generating unit 218, on the basis of the permeation time δT, and the timing control parameters relating to the sub-scanning direction and the main scanning direction determined in this manner.

Here, the permeation velocity of the ink droplet into the recording paper 16 is determined principally by the type of ink, the type of recording paper 16, the ambient temperature, the humidity, and the like.

The dot size calculating and storing unit 214 stores this various information in the form of a data table, and it calculates the parameters used to derive the permeation time 6T and supplies these to the timing calculation unit 216.

Values for the diameter D1*b* may also be calculated in advance, from the aforementioned diameter D1*a*, the diameter D2*a* and the dot interval Pt, and registered in a database. The permeation time δT can then be determined by referring to the data for the diameter D1*b* in this database. The database may be provided inside the inkjet recording apparatus 10, or it may be provided externally.

Ink type information 230 may be read in and stored by the ink type determining device 64 when an ink cartridge is installed, and this information may then be supplied to the timing calculation unit 216 when printing is carried out. Similarly, paper type information 232 may be read in and stored by the medium type determining device 60, when the recording paper 16 is loaded.

Below, the action of the present embodiment is described with reference to FIG. 18.

Figure 18:
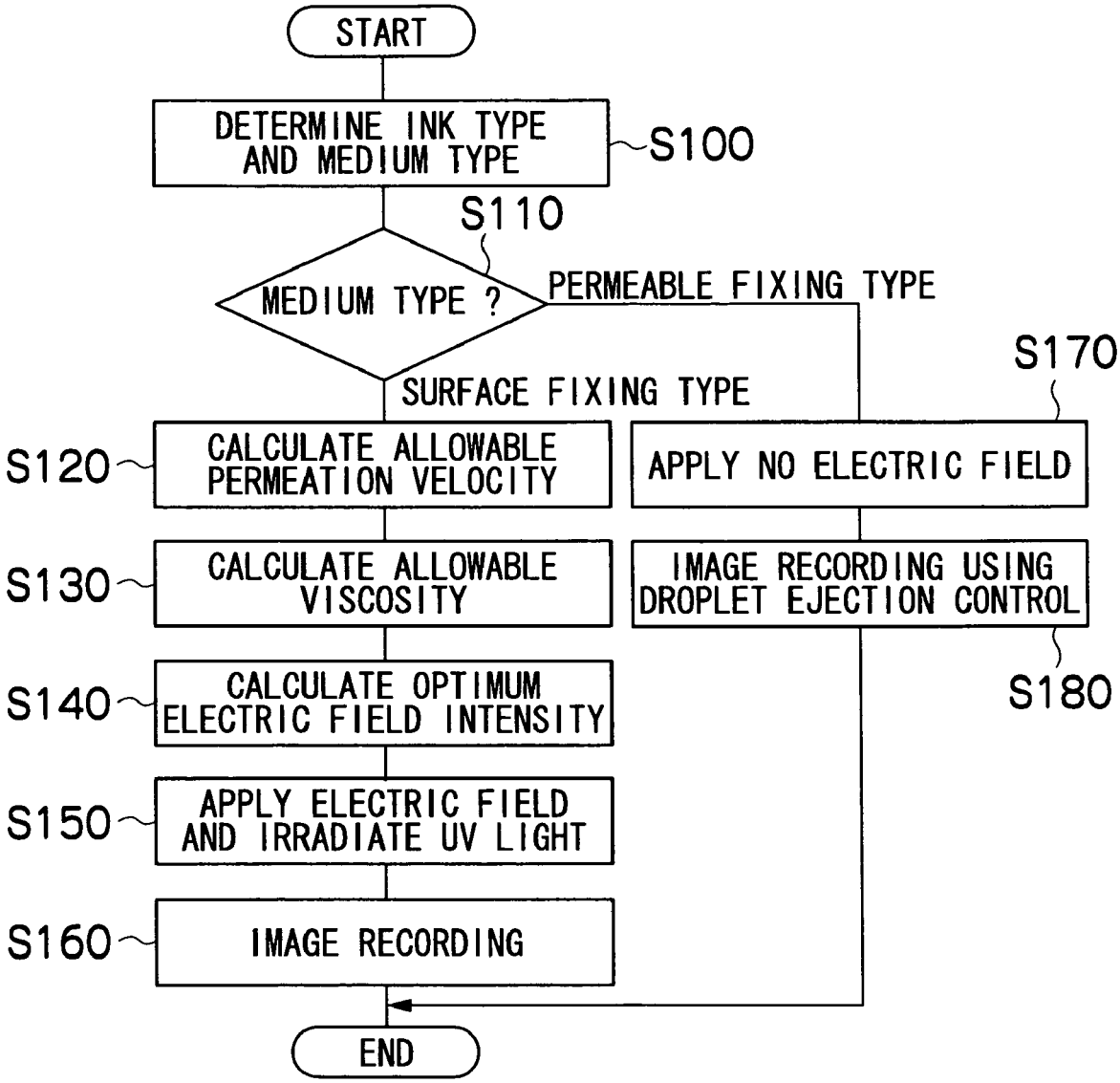
FIG. 18 is a flowchart illustrating the action of the present embodiment.

Firstly, in step S100 in FIG. 18, at the start of printing, the ink type determining device 64 determines the type of ink, and the medium type determining device 60 determines the type of recording paper 16. In the present embodiment, the ink used is taken to be UV-setting ink imparted with electrorheological properties, as described previously. The recording paper 16 is taken to be one classified as either a surface fixing type or permeable fixing type, as described above, in relation to the ink.

Next, in step S110, the system controller 80 judges whether the recording paper 16 is a surface fixing type or permeable fixing type of medium, on the basis of judgment results, and it implements processing according to the type of recording paper 16. This judgment method is not limited in particular. For example, a threshold value may be previously set for the ink permeation velocity determined by the combination of the determined recording medium type and ink type, and if the ink permeation velocity is less than this threshold value, then the medium is judged to be a surface fixing type, whereas if the ink permeation velocity is greater than this threshold value, then it is judged to be a permeable fixing type. Alternatively, preset values are established previously according to the type of recording medium.

If the recording paper 16 is judged to be a surface fixing type of medium at step S110, then the procedure advances to the processing from step S120 onwards, and the viscosity of the UV-setting ink having electrorheological properties is changed by applying a prescribed electric field, thereby controlling the permeation velocity of the ink into the recording paper 16, in order that the ink droplets do not permeate by more than a prescribed amount into the paper, but rather undergo UV setting while located on the surface of the recording paper 16.

In other words, at step S120, firstly, a desired ink permeation velocity is calculated as described above by the permeation velocity calculating unit 102 of the electric field intensity controller 68. Next, at step S130, the electric field intensity calculating unit 108 calculates an optimum viscosity corresponding to the allowable permeation velocity, by using correlation data from the ink viscosity and permeation velocity correlation data storage unit 104. Next, at step S140, the electric field intensity calculating unit 108 calculates a prescribed electric field intensity by using correlation data from the electric field intensity and ink viscosity correlation data storage unit 106.

The electric field intensity controller 68 generates an electric field control signal 10 corresponding to the prescribed electric field intensity thus calculated, and thus controls the electrodes 66 which apply an electric field to the ink that has landed on the recording paper 16. In other words, at step S150, the electrodes 66 generate an electric field in the space between the electrodes 66, on the basis of the electric field control signal 110 from the electric field intensity controller 68, in such a manner that the electric field is applied to the ink droplets deposited on the surface of the recording paper 16 that is conveyed through the space. Moreover, during this, the irradiation controller 72 controls the UV light source 70 simultaneously in such a manner that UV light is irradiated onto the ink droplets. Furthermore, at step S160, image recording is performed onto the recording paper 16 by the print unit 12 on the basis of the image data, and as the recording paper 16 is conveyed, an electric field is applied to the ink that has been deposited on the recording paper 16, thereby raising the viscosity of the ink and slowing the permeation velocity of the ink. At the same time, UV light is irradiated and the ink is caused to set by the UV light while situated on the surface of the recording paper 16. Therefore, high-quality image recording without any smearing can be achieved.

In this case, it is possible to reduce the effect of the electric field on the ink inside the print head by applying the minimum electric field necessary in order to achieve the desired ink permeation velocity. Therefore, it is possible to prevent ejection failures caused by increase in the viscosity of the ink due to the electric field.

Furthermore, if, on the other hand, it is judged at step S110 that the recording paper 16 is a permeable fixing type of medium, then no electric field is applied and the ink is allowed to permeate rapidly into the recording paper 16 while the ink viscosity is low. In other words, at step S170, the ink viscosity is controlled to a low viscosity by omitting to apply an electric field, and hence the ink permeates rapidly into the paper. At step S180, image recording is performed while controlling the droplet ejection as described above.

In this case, since the ink permeation velocity is fast, then even if dots are formed so as to overlap, as described above, it is possible to prevent landing interference between the adjacent dots by setting a relatively short droplet ejection interval and controlling droplet ejection by means of the ejection interval, as stated previously.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a droplet ejection head which ejects a droplet f a liquid having electrorheological properties toward a recording medium;

an electric field application device which applies an electric field to the droplet deposited on the recording medium;

a recording medium type determining device which determines a type of the recording medium; and an electric field intensity controller which controls intensity of the electric field applied to the droplet deposited on the recording medium by the electric field application device, in accordance with a determination result for the recording medium obtained through the recording medium type determining device, in such a manner that a permeation velocity into the recording medium of the droplet deposited on the recording medium becomes a prescribed permeation velocity.

2. The image forming apparatus as defined in claim 1, wherein, if there are different deposited droplet volumes in an image, the prescribed permeation velocity is established with reference to a representative deposited droplet volume hick is a prescribed representative value for that image.

3. The image forming apparatus as defined in claim 2, wherein the representative deposited droplet volume is a minimum deposited drop et volume.

4. The image forming apparatus as defined in claim 1, wherein, if the recording medium type determined by the recording medium type determining device is a permeable fixing type of medium in which the droplet of the liquid permeates into an image receiving layer inside the recording medium and a coloring material becomes axed inside the image receiving layer, then the electric field intensity controller performs control in such a manner that the droplet deposited on the recording medium permeates into the cording medium in a state where viscosity of the droplet is low.

5. The image forming apparatus as defined in claim 1, wherein:

the liquid is a radiation setting type of liquid;

the image forming apparatus further comprises a radiation irradiating device which irradiates radiation onto the droplet deposited on the recording medium so as to harden and fix the droplet on the recording medium; and with respect to the droplet having been deposited on the recording medium, the electric field is applied by the electric field application device and the radiation is irradiated by the radiation irradiating device.

6. The image forming apparatus as defined in clam 5, wherein:

if the type of the recording medium determine by the recording medium type determining device is a surface fixing type of medium which the droplet of the liquid principally hardens on a surface of the recording medium and a coloring material ultimately becomes fixed on the surface of the recording medium, en the electric field intensity applied by the electric field application device to the droplet is controlled by the electric field intensity controller in such a manner that a viscosity of the droplet having been deposited on the recording medium is increased and a permeation velocity becomes such that, of a deposited droplet volume, a droplet volume of a prescribed ratio or less permeates into the recording. medium before the liquid hardens completely on the recording medium by the irradiation.

7. The image forming apparatus as defined in claim 6, wherein the prescribed ratio is set according to the type of recording medium.

8. The image forming apparatus as defined in claim 6, wherein the prescribed ratio is 30%.

9. The image forming apparatus as defined in claim 5, wherein, if different deposited droplet volumes exist in an image, the prescribed permeation velocity is established with reference to a representative deposited droplet volume which is a prescribed representative value for that image.

10. The image forming apparatus as defined in claim 9, wherein the representative deposited droplet volume is a minimum deposited droplet volume.

11. The image forming apparatus as defined in claim 5, wherein the electric field intensity controller comprises:

a permeation velocity calculating unit which calculates the prescribed permeation velocity according to irradiation energy irradiated by the radiation irradiating device, the conveyance velocity at which the recording medium is conveyed relatively to the droplet ejection head, and the deposited droplet volume;

a first storage unit which stores correlation data for liquid viscosity and permeation velocity;

a second storage unit which stores correlation to for electric field intensity and liquid viscosity; and an electric field intensity calculating unit whit calculates an electric field intensity, wherein the electric field intensity calculating 't calculates a prescribed electric field intensity according to the prescribed permeation v locity calculated by the permeation velocity calculating unit, the correlation data in the first storage unit and the correlation data in the second storage unit.

12. The image forming apparatus as defined in claim 5, wherein the electric field intensity controller comprises:

a permeation velocity calculating unit which calculates the prescribed permeation velocity according to irradiation energy irradiated by the radiation irradiating device, the conveyance velocity at which the recording medium is conveyed relatively to the droplet ejection head, and the deposited droplet volume; and an electric field intensity calculating unit whit calculates a prescribed electric field intensity according to correlation data relating electric field intensity applied to the droplet with respect to permeation velocity of the droplet into a recording medium, as determined according to a type of the liquid and the type of the recording medium.

13. The image forming apparatus as defined in claim 5, wherein, if the recording medium type determined by the recording medium type determining device is a permeable fixing type of medium in which the droplet of the liquid permeates into an image receiving layer inside the recording medium and a coloring material becomes axed inside the image receiving layer, then the electric field intensity controller performs control in such a manner that the droplet deposited on the recording medium permeates into the recording medium in a state where viscosity of the droplet is low.

14. A method for controlling an image forming apparatus comprising determining a type of a recording medium;

ejecting a droplet of a liquid having electrorheological properties to the recording medium;

applying an electric field to the droplet deposited on the recording medium; and determining the intensity of the electric field to be applied, in accordance with the type of recording medium such that a permeation velocity of the droplet deposited on the recording medium becomes a prescribed permeation velocity.

15. The method according to claim 14, further comprising controlling the electric field intensity in such a manner that the droplet deposited on the recording medium permeates into the recording medium in a state where viscosity of the droplet is low, if it is determined that the type of the recording medium is a permeable fixing type of medium in which the droplet of the liquid permeates into an image receiving layer inside the recording medium and a coloring material becomes fixed inside the image receiving layer.

16. The method according to claim 14, wherein the liquid is a radiation-setting type of liquid, and further comprising irradiating radiation onto the droplet deposited on the recording medium.

17. The method according to claim 16, further comprising calculating the prescribed permeation velocity according to the irradiation energy irradiated, the conveyance velocity at which the recording medium is conveyed relative to the droplet ejection head, and the deposited droplet volume;

storing correlation data for liquid viscosity and permeation velocity;

storing correlation data for electric field intensity and liquid viscosity; and calculating the electric field intensity according to the calculated prescribed permeation velocity, the correlation data for liquid viscosity and permeation velocity, and the correlation data for electric field intensity and liquid viscosity.

18. The method according to claim 16, further comprising calculating the prescribed permeation velocity according to the irradiation energy irradiated, the conveyance velocity at which the recording medium is conveyed, and the deposited droplet volume; and calculating a prescribed electric field intensity according to correlation data relating electric field intensity applied to the droplet with permeation velocity of the droplet into the recording medium, as determined according to a type of the liquid and the type of the recording medium.

19. The method according to claim 16, further comprising controlling the electric field intensity in such a manner that the droplet deposited on the recording medium permeates into the recording medium in a state where viscosity of the droplet is low, if it is determined that the type of the recording medium is a permeable fixing type of medium in which the droplet of the liquid permeates into an image receiving layer inside the recording medium and a coloring material becomes fixed inside the image receiving layer.

20. A method for controlling an image forming apparatus, comprising determining a type of a recording medium;

ejecting a droplet of a liquid having electrorheological properties to the recording medium;

determining if an electric field should be applied in accordance with the type of recording medium;

applying an electric field to the droplet deposited on the recording medium, if it is determined that the recording medium is a surface fixing type; and applying no electric field to the droplet deposited on the recording medium, if it is determined that the recording medium is a permeable fixing type.

21. A method for controlling an image forming apparatus according to claim 20, further comprising determining the intensity of the electric field to be applied, if it is determined that the recording medium is said surface fixing type, such that a permeation velocity of the droplet deposited on the recording medium becomes a prescribed permeation velocity.

* * * * *